US005545486A

United States Patent [19]

Asano et al.

[11] Patent Number: 5,545,486

[45] Date of Patent: Aug. 13, 1996

[54] ORNAMENTAL TAPE OR RIBBON

[76] Inventors: Eiji Asano, 5-28, Nijigahama, Hiratsuka-shi, Kanagawa-ken 254; Yoshiko Iwaki, 8-17-302, Minami Kugahara 2-chome, Oota-ku, Tokyo 144, both of Japan

[21] Appl. No.: 359,842

[22] Filed: Dec. 20, 1994

Related U.S. Application Data

[63] Continuation of Ser. No. 131,875, Oct. 5, 1993, abandoned, which is a continuation of Ser. No. 721,534, filed as PCT/JP90/01467 published as WO91/07533, May 30, 1991, abandoned.

[30] Foreign Application Priority Data

Nov. 13, 1989 [JP] Japan ..... 1-131053

[51] Int. Cl.[6] ..... D04D 7/10

[52] U.S. Cl. ..... 428/542.8; 28/147; 223/46; 428/4; 428/5

[58] Field of Search ..... 28/147; 223/46; 428/4, 5, 542.8

[56] References Cited

U.S. PATENT DOCUMENTS

| | | | |
|---|---|---|---|
| 2,471,590 | 5/1949 | Southgate | 428/5 |
| 2,562,919 | 8/1951 | James | 428/5 |
| 3,063,590 | 11/1962 | Hopkins | 428/5 X |
| 5,116,687 | 5/1992 | Asano et al. | 428/5 X |

FOREIGN PATENT DOCUMENTS

| | | | |
|---|---|---|---|
| 26-10176 | 9/1951 | Japan | 428/4 |
| 34-764 | 1/1959 | Japan | 428/4 |
| 64-4867 | 1/1989 | Japan | 428/4 |

*Primary Examiner*—Henry F. Epstein
*Attorney, Agent, or Firm*—Armstrong, Westerman, Hattori, McLeland & Naughton

[57] ABSTRACT

An ornamental tape or ribbon having a base portion; a plurality of spindle-shaped tape portions extending from at least one side of the base portion; a plurality of suspended tape portions vertically extending from one of an upper and a lower side of the base portion; and a fastening tape portion vertically extending from another of an upper side and a lower side of the base portion across the base portion and having a tab for engagement in a slot where the vertically extending tape portions join the base portion.

5 Claims, 5 Drawing Sheets

ORNAMENTAL TAPE OR RIBBON

This application is a continuation of application Ser. No. 08/131,875, filed Oct. 5, 1993, now abandoned which is a continuation of application Ser. No. 07/721,534, filed as PCT/JP90/01467, Nov. 13, 1989 published as WO91/07533, May 30, 1991, now abandoned.

FIELD OF THE INVENTION

The present invention relates to an improvement on an ornamental tape or ribbon used in packaging.

DESCRIPTION OF THE PRIOR ART

Heretofore, it has been known to provide conventional ornamental tape or ribbon used in packaging, which ribbon is made of synthetic resin and is produced as follows: in a first step, a resilient sheet material of the synthetic resin is blanked with a suitable die to produce a tape blank having a plurality of spindle-shaped tape portions and a plurality of neck portions through each of which the spindle-shaped tape portions are integrally connected with each other; in a second step, a hole is formed in each of the neck portions of the tape blank to permit an end of a string to pass through every one of these holes, in sequence, so that the end of the string is fixed to the last one of the holes; and in a third step, the other or free end of the string is pulled to cause each of the spindle-shaped tape portions of the tape blank to be folded in half in sequence so as to, in sequence, assume a bow-tie form, a plurality of which bow-tie forms are then stacked together, whereby the conventional ornamental tape or ribbon used packaging is produced.

The conventional ornamental tape or ribbon having the above construction is characterized in that the tape blank is folded by the pulling of the string, through which pulling the thus folded tape blank assumes the form of stacked bow-ties. As is clear from the above, the conventional ribbon is complex in construction since it is constructed of a plurality of parts, i.e., the tape blank and the string passing through the blank. In addition, as for the assembling operation thereof, it is very cumbersome to perform the above second step for passing the string through the holes formed in the neck portions of the tape blank. Further, in some cases, there is a fear that the string impairs the handling properties of the ribbon in use.

SUMMARY OF THE INVENTION

It is an object of the present invention to provide an ornamental tape or ribbon used in packaging, which ribbon is very simple in construction while formed into a completed bow-tie shape through a single folding operation of a tape blank of the ribbon, the ribbon of the present invention being excellent in design, and, therefore excellent in the ornamental effect thereof.

The above object of the present invention is accomplished by providing:

An ornamental tape or ribbon comprising:

a base portion;

a predetermined number of spindle-shaped tape portions which are integrally formed with the base portion so as to laterally extend therefrom, the spindle-shaped tape portions being foldable;

at least a pair of suspended tape portions which are integrally formed with the base portion so as to vertically extend therefrom; and a fastening tape portion which is integrally formed with the base portion so as to vertically extend therefrom, the fastening tape portion being folded to pass through the base portion from its front side to a rear side of the same, so that the spindle-shaped tape portions having been folded is fastened to the base portion by the thus folded fastening tape portion.

In the ornamental tape or ribbon of the present invention, the spindle-shaped tape portions of the ribbon may be formed in only one side of the base portion of the ribbon, or formed in opposite sides of the base portion.

Further, the fastening tape portion of the ribbon of the present invention may be formed in the same side of the base portion as for the suspended tape portions of the ribbon, or formed in the other side of the base portion different from the side (of the base portion) in which the suspended tape portions are formed.

In the ribbon of the present invention, the fastening tape portion thereof may be fastened to the base portion of the ribbon through any desirable fastening means which may be a slot formed in a suitable area of the base portion or of each of the spindle-shaped tape portions of the ribbon.

DESCRIPTION OF THE PREFERRED EMBODIMENTS

The present invention will be described in detail with reference to the accompanying drawings.

Figure 1:
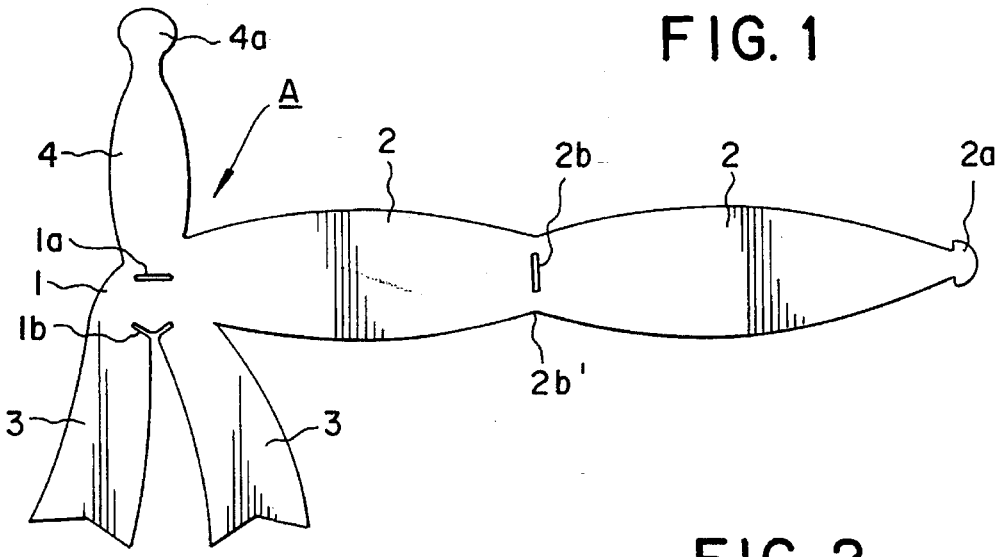
FIG. 1 is a plan view of a first embodiment of the ornamental tape or ribbon of the present invention.

FIGS. 1 to 4 show a first embodiment of the present invention. In the drawings, the reference character "A" denotes an ornamental tape of ribbon of the present invention. The ribbon "A" of the first embodiment of the present invention is made of ethylene-vinyl acetate (EVA) resin. More particularly, a laminated color sheet of the EVA resin is blanked with a suitable die to produce the ribbon "A" opposite sides of which is colored. The ribbon "A" is provided with: a central base portion 1; a pair of spindle-shaped tape portions 2 which are integrally formed with the base portion 1 so as to laterally extend from a side of the base portion 1 in series-as shown in FIG. 1, the spindle-shaped tape portions 2 being foldable; a pair of suspended tape portions 3 which are integrally formed with the base portion 1 so as to vertically extend from a lower side of the base portion 1; and a fastening tape portion 4 which is integrally formed with the base portion 1 so as to vertically extend from an upper side of the base portion 1, the fastening tape portion 4 being foldable.

Of the spindle-shaped tape portions 2 of the ribbon "A", an outer one 2 is provided with a tab 2*a* in its end portion. In addition, the fastening tape portion 4 is also provided with a tab 4*a* in its end portion. The tabs 2*a* and 4*a* are integrally formed with the outer spindle-shaped tape portion 2 and the fastening tape portion 4, respectively.

On the other hand, a slot 2*b* is formed in a neck portion 2*b'* disposed between the spindle-shaped tape portions 2 of the ribbon "A". Another slot la is formed in a substantially central area of the base portion 1 of the ribbon "A". Further, a slit 1*b* is formed in a branch area between the base portion 1 and the suspended tape portions 3, as shown in FIG. 1.

Figure 2:
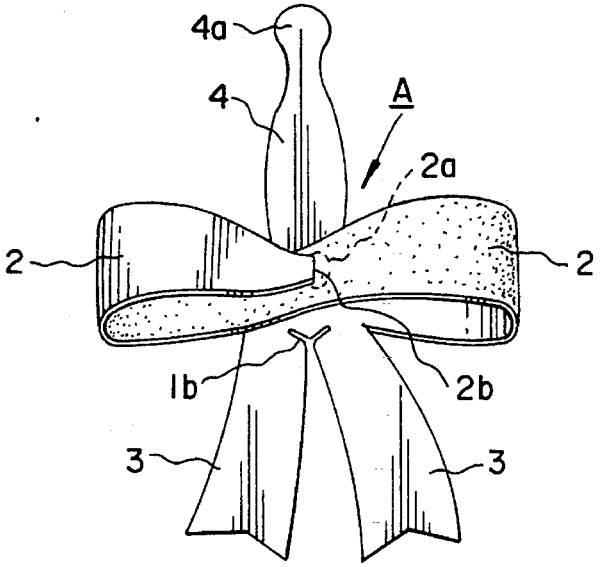
FIG. 2 is a perspective view of the ribbon of the present invention shown in FIG. 1, having been partially folded.

The ornamental tape of ribbon "A" of the present invention has the above construction. A pattern of the ribbon "A" is shown in FIG. 1, which pattern is folded into a shape shown in FIG. 3. Namely, in folding of the pattern, as shown in FIG. 2, first of all, each of the spindle-shaped tape portions 2 of the ribbon "A" is folded in half in sequence. Then, the tab 2*a* of the outer one of the spindle-shaped tape portions 2 is inserted into the slot 2*b*, in neck portion 2*b*; to prevent each of the spindle-shaped tape portions 2 from returning its flat condition under the influence of resiliency of the pattern or ribbon "A", so that the thus folded spindle-shaped tape portions 2 of the ribbon "A" is temporarily engaged with the base portion 1 of the ribbon "A". After that, the fastening tape portion 4 of the ribbon "A" is folded in half to have its tab 4*a* pass through the slit 1*b* from a front surface of the base portion 1 to a rear surface thereof and the tab 4*a* is engaged with the slit 1*b*, whereby each of the spindle-shaped tape portions 2 having been folded in half in front of the base portion 1 is fastened to the base portion 1 by the fastening tape portion 4. As a result, the pattern of the ribbon "A" shown in FIG, 1 is formed into a bow-tie shape as shown in FIG. 3.

Figure 3:
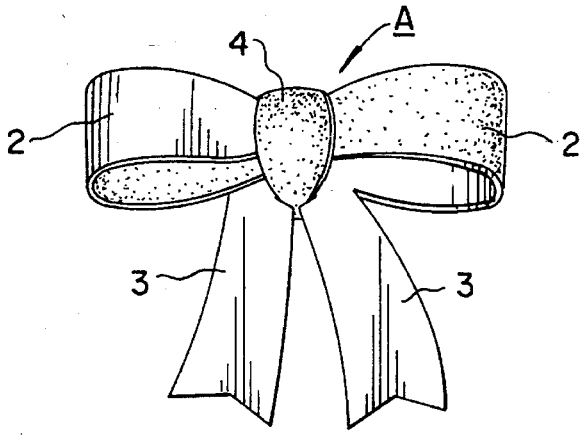
FIG. 3 is a perspective view of the ribbon of the present invention shown in FIG. 1, having been entirely folded.

In case that the pattern of the ribbon "A" has its front surface assume a color different from that of the rear surface of the pattern, the folded or completed ribbon "A" of the present invention may show a rich variety of color, as shown by striped and plain surfaces in FIGS. 2 and 3.

Figure 4:
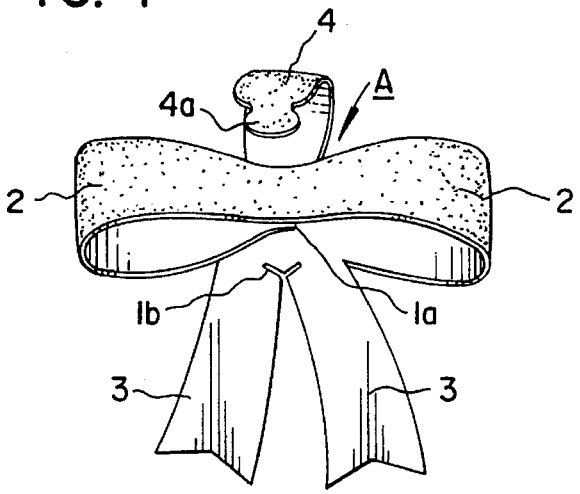
FIG. 4 is a perspective view of a modification of the first embodiment of the ribbon of the present invention shown in FIG. 1, having been partially folded, the modification being different in folding manner from the first embodiment shown in FIGS. 1 to 3.

In addition, when the spindle-shaped tape portions 2 of the pattern of the first embodiment of the ribbon "A" shown in FIG. 1 are folded in another way different from that shown in FIG. 2, a modification of the first embodiment of the ribbon "A" is completed as shown in FIG. 4. More specifically, as shown in FIG. 4, in the folding operation of this modification: in a first step, the spindle-shaped tape portions 2 are folded, in a first direction, outwardly and over base portion 1 with neck portion 2*b'* overlaying base portion 1, the outermost portion 2 is folded outwardly and back in a direction opposite to the first direction and the tab 2*a*, at the outer end of outermost tape portion 2, is twisted and inserted into the slot 1*a* of the base portion 1 so that the spindle-shaped tape portions 2 are folded so as to be symmetrically arranged with respect to the base portion 1; and, in a second or last step, the tab 4*a* of the fastening tape portion 4 is engaged with the slit 1*b* of the ribbon "A" in the same way as that of the first embodiment of the present invention shown in FIG. 3, so that the ribbon "A" of the modification shown in FIG. 4 is tied in a bow. As is clear from FIG. 4, the completed ribbon "A" of the modification shown in FIG. 4 partially differs in color (of the spindle-shaped tape portions 2) from that of the first embodiment of the present invention shown in FIG. 3, so that the modification of the present invention shown in FIG. 4 may make a variety of color of the ribbon "A" richer.

Figure 5:
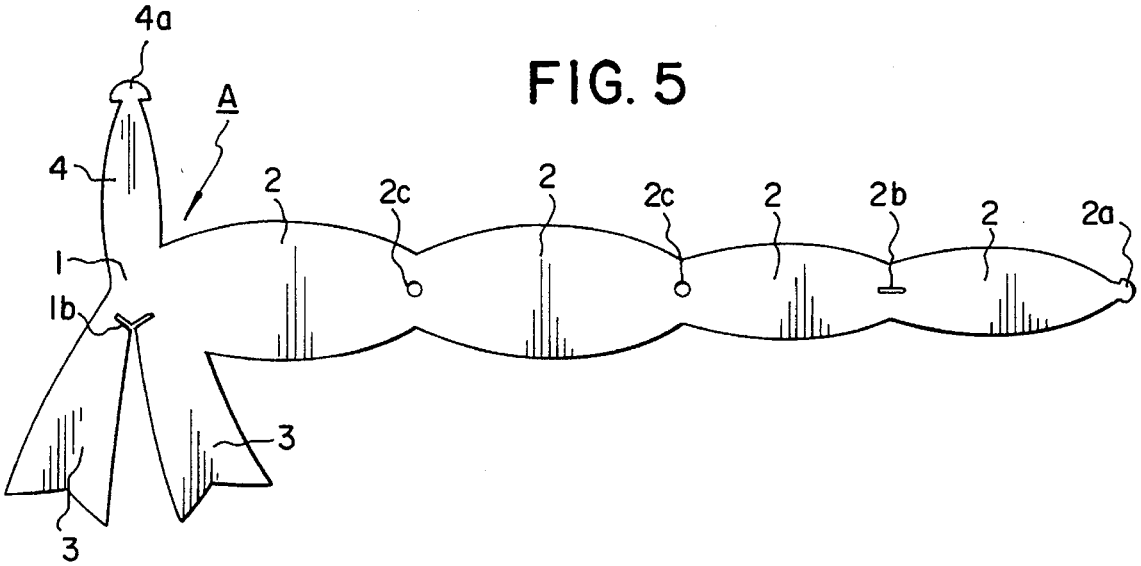
FIG. 5 is a pattern view of a second embodiment of the ribbon of the present invention.
Figure 6:
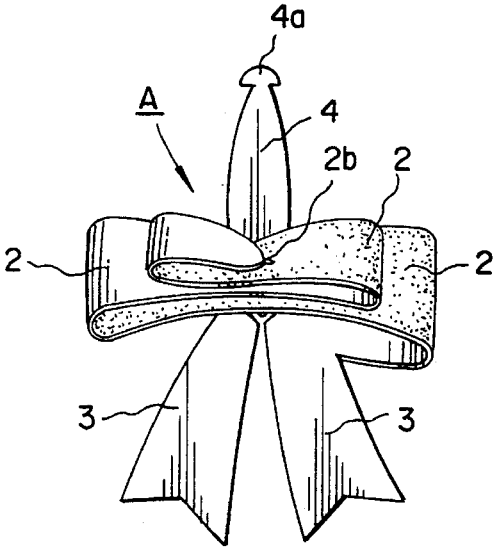
FIG. 6 is a perspective view of the folded or completed ornamental tape or ribbon of the embodiment shown in FIG. 5.

FIGS. 5 and 6 show a second embodiment of the ribbon "A" of the present invention. In the drawings, like reference numerals apply to similar parts throughout the several views.

In this second embodiment of the present invention, there are employed four pieces of the spindle-shaped tape portions 2 two of which are adjacent to the base portion 1 in series and are larger in length and width than the remaining tape portions 2. As a result, when the spindle-shaped tape portions 2 of the second embodiment of the present invention are folded as shown in FIG. 6, a double bow-tie is formed on the base portion 1 of the ribbon "A". Incidentally, in the pattern of the ribbon "A" shown in FIG. 5, each of holes 2*c* formed in neck portions of the pattern between the spindle-shaped tape portions 2 is a mark for indicating a folding area of the pattern being folded. It is possible to eliminate these marks or holes 2*c* from the pattern of the ribbon "A" shown in FIG. 5.

Figure 7:
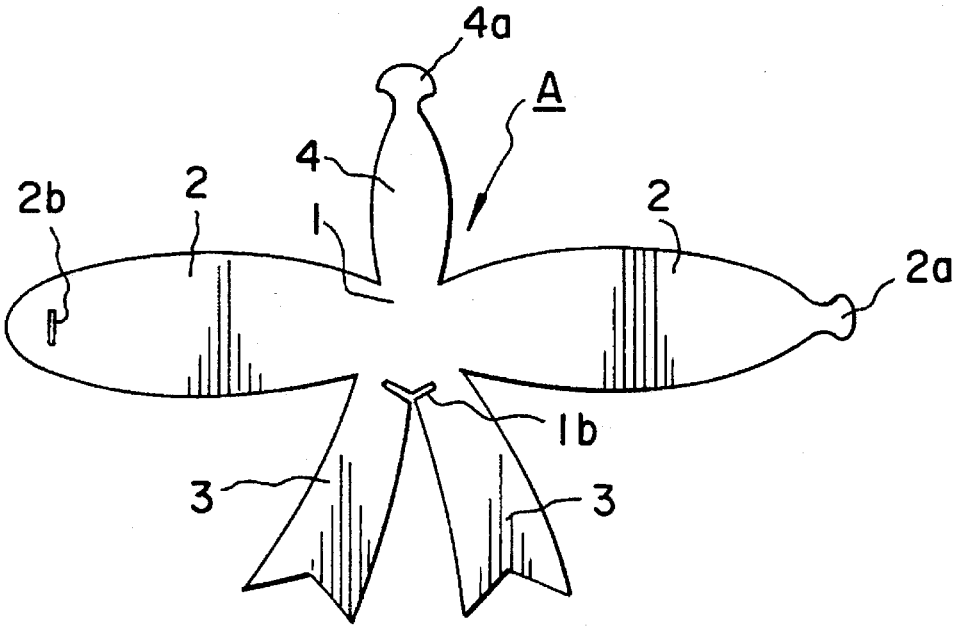
FIG. 7 is a pattern view of a third embodiment of the ribbon of the present invention.
Figure 8:
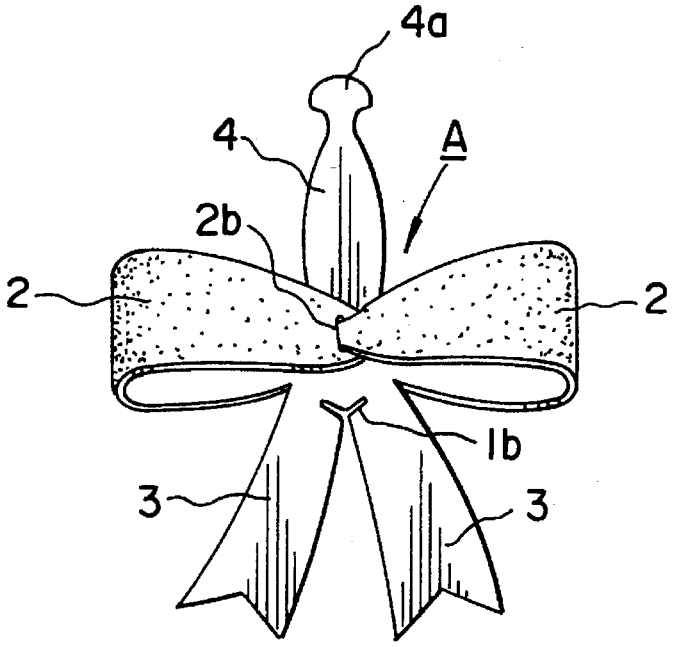
FIG. 8 is a perspective view of the folded or completed ribbon of the embodiment shown in FIG. 7.

FIGS. 7 and 8 show a third embodiment of the ribbon "A" of the present invention, in which embodiment the spindle-shaped tape portion 2 is integrally formed with the base portion 1 so as to laterally extend from each of opposite sides of the base portion 1. The pattern of the third embodiment of the present invention is folded in a manner shown in FIG. 8 to form an essential bow-tie part of the ribbon "A".

Figure 9:
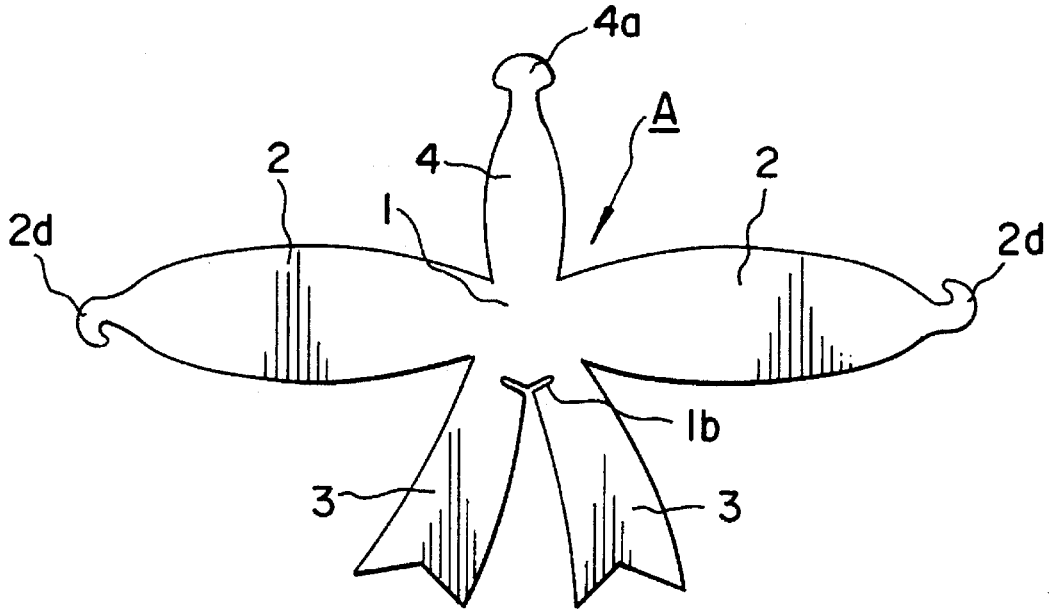
FIG. 9 is a pattern view of a modification of the third embodiment of the ribbon of the present invention shown in FIGS. 7 and 8.
Figure 10:
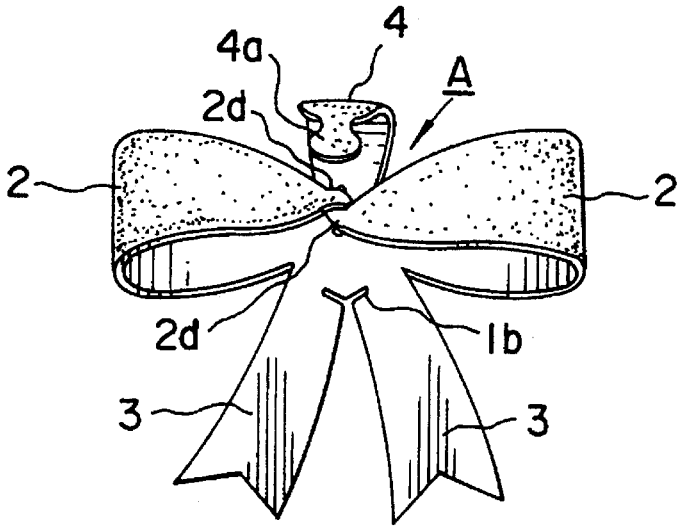
FIG. 10 is a perspective view of the modification of the third embodiment of the present invention shown in FIGS. 7 and 8.

FIGS. 9 and 10 show a modification of the third embodiment of the present invention shown in FIGS. 7 and 8, in which modification a hook 2*d* is integrally formed with an outer end of each of the spindle-shaped tape portions 2 which are symmetrically arranged with respect to the base portion 1. In folding operation of the pattern of the modification of the ribbon "A" shown in FIG. 9: in a first step, each of the spindle-shaped tape portions 2 is folded in half to permit the hooks 2*d* of the spindle-shaped tape portions 2 to engage with each other; and, in a second or last step, the fastening tape portion 4 is folded in half to have its hook 4*a* engaged with the slit 1*b* of the ribbon "A" so that the ribbon "A" is tied in a bow, as is in each of the above embodiments and modification of the present invention.

In each of the above embodiments and modification of the first embodiment of the present invention, the tabs 2*a* and 4*a* are engaged with the slot 1*a* and the slit 1*b*, respectively. However, it is also possible to fasten the ends of the spindle-shaped tape portions 2 to the base portion 1 by the use of suitable fastening means such as heat sealing means, gluing means, mechanical fastening means such as staplers and like fastening means.

Figure 11:
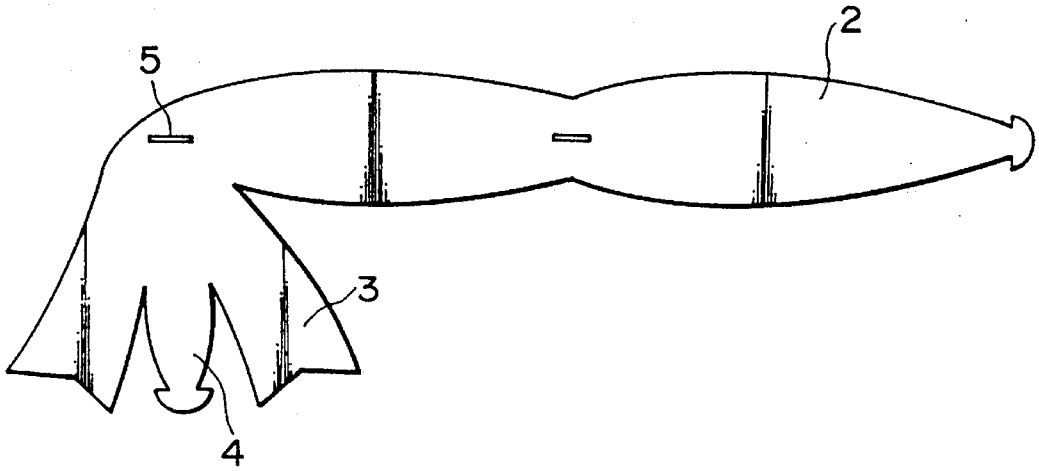
FIG. 11 is a pattern view of a fourth embodiment of the present invention.
Figure 12:
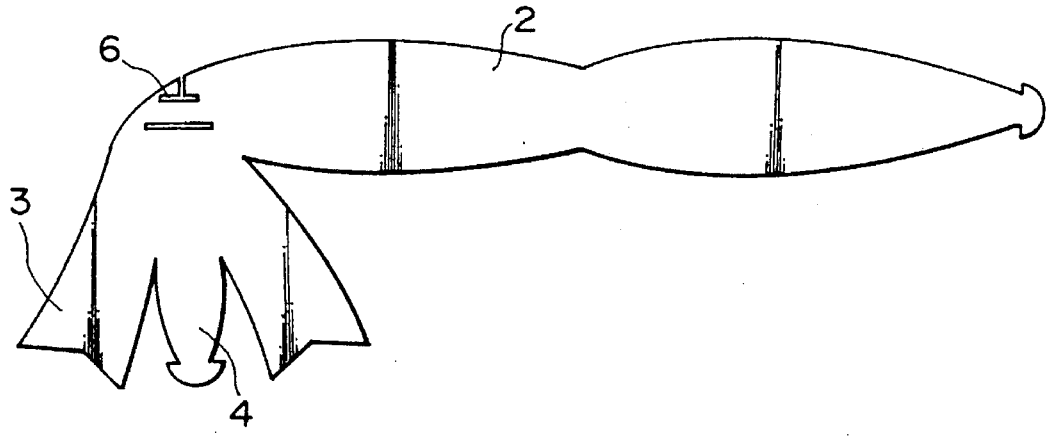
FIG. 12 is a pattern view of a fifth embodiment of the present invention.
Figure 13:
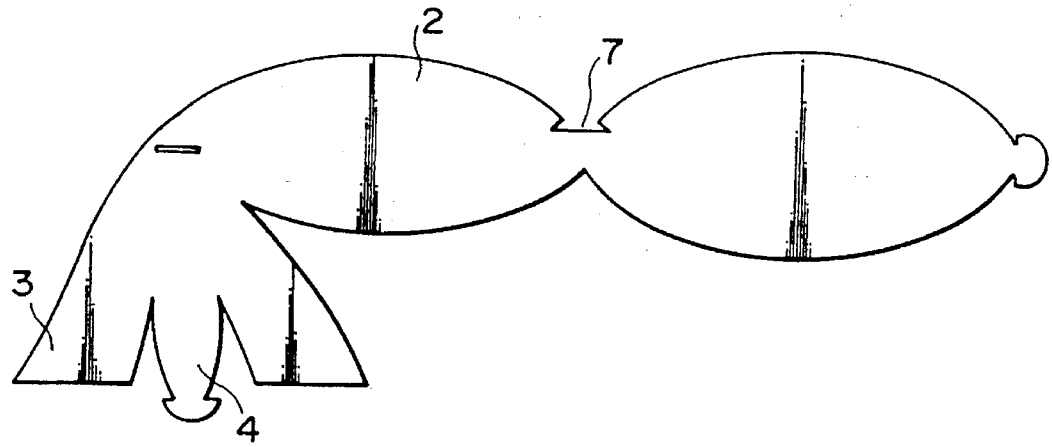
FIG. 13 is a pattern view of a sixth embodiment of the present invention.

FIGS. 11, 12 and 13 show a fourth, fifth and sixth embodiments of the ribbon "A" of the present invention, respectively, in each of which embodiments the fastening tape portion 4 is so integrally formed with the base portion 1 as to vertically extend from the lower side of the base portion 1. More specifically, in each of the embodiments of the present invention shown in FIGS. 11 to 13, the fastening tape portion 4 is provided between the suspended tape portions 3 and extends downward as is in case of the suspended tape portions 3.

In the fourth embodiment of the present invention shown in FIG. 11, as a means for fastening the fastening tape portion 4 to the base portion 1, there is employed a thin slot 5 in the base portion 1 for receiving a mushroom-like end of the fastening tape portion 4 therein. On the other hand, in the fifth embodiment of the present invention shown in FIG. 12, as a means for fastening the fastening tape portion 4 to the base portion 1, there is employed a T-shaped slit 6 in an upper area of the base portion 1 for receiving a mushroom-like end of the fastening tape portion 4 therein. In the sixth embodiment of the present invention shown in FIG. 13, as a means for fastening the fastening tape portion 4 to the base portion 1, there is employed a notch 7 in a neck portion between the spindle-shaped tape portions 2, which notch 7 receives a mushroom-like end of the fastening tape portion 4 therein.

Each of the thin slot 5, T-shaped slit 6 and the notch 7 described above is used to fasten the mushroom-like end of the fastening tape portion 4 to the base portion 1 of the ribbon "A" in folding operation of the pattern of each of the embodiments shown in FIGS. 11 to 13.

As for the industrial applicability of the present invention, as described in the above, according to the present invention, it is possible to provide the ornamental tape or ribbon used in packaging, which ribbon is simple in construction and excellent in design, and, therefore excellent in ornamental effect, the ribbon of the present invention being easily formed or completed by only folding the pattern of the ribbon. Incidentally, the ornamental tape or ribbon of the present invention having been completed is bonded in use to an article (to be ornamented therewith) by means of a suitable bonding means, for example such as double-faced adhesive tapes, adhesive agents and the like.

We claim:

1. An ornamental tape foldable into a decorative ribbon comprising:

a base portion;

a slot passing through said base portion a predetermined number of spindle-shaped tape portions integrally joined by neck portions and extending laterally from said base portion, a slot passing through said neck portion remotest from said base portion, said spindle-shaped portions being foldable, one spindle-shaped tape portion over the other, at said neck portions, the end portion of the spindle-shaped tape portion remotest from said base portion having a tab selectively engagable in either one of said slots passing through said neck portion remotest from said base portion or said slot passing through said base portion when said spindle-shaped portions are folded;

at least a pair of tape portions integrally formed with and vertically extending from one side of said base portion, each of said pair of tape portions having a slot extending inwardly from the opposing sides of said each of said pair of tape portions where said pair of tape portions extend integrally from said base portion; and a fastening tape portion integrally formed with and vertically extending from the other side of said base portion and, at its end remotest from said base portion having a tab engagable with said slots extending inwardly from said opposite sides of each of said pair of tape portions, wherein, when said spindle-shaped portions are folded, one spindle-shaped portion over the other, said tab on said spindle-shaped tape portion is inserted into at least one of said slots passing through said neck portion and said base portion and said fastening tape is folded over said base portion and said tab at the end of said fastening tape portion is inserted in said slots extending inwardly from said opposing sides of said each of said pair of tape portions, said decorative ribbon is formed.

2. The ornamental tape as set forth in claim 1, wherein:

said spindle-shaped tape portions of said decorative ribbon are formed in only one side of said base portion of said decorative ribbon.

3. The ornamental tape as set forth in claim 1, wherein:

said spindle-shaped tape portions of said decorative ribbon are formed on opposite sides of said base portion.

4. An ornamental tape foldable into a decorative ribbon comprising:

a base portion;

a slot passing through said base portion a predetermined number of spindle-shaped tape portions integrally joined by neck portions and extending laterally from said base portion, a slot passing through said neck portion remotest from said base portion, said spindle-shaped portions being foldable, one spindle-shaped tape portion over the other, at said neck portions, the end portion of the spindle-shaped tape portion remotest from said base portion having a tab to be fixed to one of said neck portion remotest from said base portion and said base portion;

at least a pair of tape portions integrally formed with and vertically extending from one side of said base portion, each of said pair of tape portions having a slot extending inwardly from the opposing sides of said each of said pair of tape portions where said pair of tape portions extend internally from said base portion; and a fastening tape portion integrally formed with and vertically extending from the other side of said base portion and, at its end remotest from said base portion having a tab engagable with said slots extending inwardly from said opposite sides of each of said pair of tape portions, wherein, when said spindle-shaped portions are folded, one spindle-shaped portion over the other, said tab on said spindle shaped tape portion is fixed to one of said neck portion remotest from said base portion and said base portion and said fastening tape is folded over said base portion and said tab at the end of said fastening tape portion is inserted in said slots extending inwardly from said opposing sides of said each of said pair of tape portions, said decorative ribbon is formed.

5. A decorative ribbon as claimed in claim 4, in which a slit for fixing the tab of said spindle-shaped portion is formed on said neck portion remotest from said base portion.

* * * * *

UNITED STATES PATENT AND TRADEMARK OFFICE

CERTIFICATE OF CORRECTION

PATENT NO. : 5,545,486
DATED : August 13, 1996
INVENTOR(S) : Eiji ASANO et al

It is certified that error appears in the above-indentified patent and that said Letters Patent is hereby corrected as shown below:

Claim 5, column 6, line 62, change "slit" to --slot--.

Signed and Sealed this

Fourth Day of February, 1997

*Attest:*

Bruce Lehman

BRUCE LEHMAN

*Attesting Officer*

*Commissioner of Patents and Trademarks*